US009591741B2

(12) United States Patent
Larigaldie

(10) Patent No.: US 9,591,741 B2
(45) Date of Patent: Mar. 7, 2017

(54) PLASMA THRUSTER AND METHOD FOR GENERATING A PLASMA PROPULSION THRUST

(71) Applicant: ONERA (Office National d'Etudes et de Recherches Aerospatiales), Chatillon (FR)

(72) Inventor: Serge Larigaldie, Chatenay Malabry (FR)

(73) Assignee: ONERA (Office National d'Etudes et de Recherches Aerospatiales), Chatillon (FR)

( * ) Notice: Subject to any disclaimer, the term of this patent is extended or adjusted under 35 U.S.C. 154(b) by 309 days.

(21) Appl. No.: 14/369,282

(22) PCT Filed: Dec. 19, 2012

(86) PCT No.: PCT/FR2012/052983
§ 371 (c)(1),
(2) Date: Jun. 27, 2014

(87) PCT Pub. No.: WO2013/098505
PCT Pub. Date: Jul. 4, 2013

(65) Prior Publication Data

US 2015/0020502 A1 Jan. 22, 2015

(30) Foreign Application Priority Data

Dec. 29, 2011 (FR) ..... 11 62545

(51) Int. Cl.
*H05H 7/08* (2006.01)
*H01J 27/18* (2006.01)
(Continued)

(52) U.S. Cl.
CPC ..... *H05H 7/08* (2013.01); *F03H 1/0081* (2013.01); *H01J 27/18* (2013.01); *H05H 1/46* (2013.01);
(Continued)

(58) Field of Classification Search
CPC .... F03H 1/0006; F03H 1/0062; F03H 1/0075; F03H 1/0068; B64G 1/40
See application file for complete search history.

(56) References Cited

U.S. PATENT DOCUMENTS 6,195,980 B1 3/2001 Walther

OTHER PUBLICATIONS

Reisz Engineers, Resonance Electron-Cyclotron Throttleable Rocket dated Dec. 22, 2009, extracted from the Internet: URL: http://www.reiszengrs.com/space.php4 on Sep. 14, 2012.
(Continued)

*Primary Examiner* — Gerald L Sung
*Assistant Examiner* — William Breazeal
(74) *Attorney, Agent, or Firm* — Patzik, Frank & Samotny Ltd.

(57) ABSTRACT

The invention, which relates to a miniaturizable plasma thruster, consists of: —igniting the plasma by microhollow cathode discharge close to the outlet and inside the means for injecting the propellant gas, said injection means being magnetic and comprising a tip at the downstream end thereof; —bringing the electrons of the magnetized plasma into gyromagnetic rotation, at the outlet end of said injection means; —sustaining the plasma by means of Electron Cyclotron Resonance (ECR), said injection means being metal and being used as an antenna for electromagnetic (EM) emission, the volume of ECR plasma at the outlet of said injection means being used as a resonant cavity of the
(Continued)

EM wave; —accelerating the plasma in a magnetic nozzle by diamagnetic force, the ejected plasma being electrically neutral.

10 Claims, 4 Drawing Sheets

(51) Int. Cl.

| | |
|---|---|
| ***F03H 1/00*** | (2006.01) |
| ***H05H 1/46*** | (2006.01) |
| ***H01H 1/54*** | (2006.01) |
| ***H05H 7/02*** | (2006.01) |
| ***H05H 13/00*** | (2006.01) |
| ***H05H 1/54*** | (2006.01) |

(52) U.S. Cl.
CPC ..... *H05H 1/54* (2013.01); *H05H 7/02* (2013.01); *H05H 13/005* (2013.01); *H05H 2001/4607* (2013.01); *H05H 2007/027* (2013.01); *H05H 2007/082* (2013.01); *H05H 2007/087* (2013.01)

(56) References Cited

OTHER PUBLICATIONS

Brainerd, Jerome J. et al., Electron-Cyclotron Resonance Thruster dated Dec. 22, 2009, extracted from the Internet: URL:http://nextbigfuture.com/2009/12/electron-cyclotron-resonance-thruster.html on Sep. 14, 2012.
Brainerd, J.D. et al., Bimodal Velocity Profile Measured by Laser-Induced Fluorescence in the Jet of an ECR Thruster, 44th AIAA/ASME/SAE/ASEE Joint Propulsion Conference and Exhibit, pp. 1-10, Jul. 21-23, 2008, Hartford Connecticut.
Brainerd, Jerome J. et al., Electrodeless Experimental Thruster, American Institute of Physics Conference Proceedings, pp. 126-132, Jan. 1, 2009.
Rovey, Joshua L., et al., Plasma Properties in the Magnetic Nozzle of an Electron Cyclotron Resonance Plasma Source, 44th AIAA/ASME/SAE/ASEE Joint Propulsion Conference and Exhibit, pp. 1-12, Jul. 21-23, 2008, Hartford Connecticut.
Stallard, et al., Whistler-Driven, Electron-Cyclotron-Resonance-Heated Thruster: Experimental Status, Journal of Propulsion and Power, American Institute of Aeronautics and Astronautics, vol. 12, No. 4, pp. 814-816, Jul. 1, 1996, New York, New York.
European Patent Office, International Search Report issued in corresponding PCT Application No. PCT/FR2012/052983, May 24, 2013.

PLASMA THRUSTER AND METHOD FOR GENERATING A PLASMA PROPULSION THRUST

FIELD OF THE INVENTION

The invention relates to a plasma thruster and a method for generating a propulsion thrust by means of said plasma thruster.

BACKGROUND OF THE INVENTION

Artificial satellites generally use auxiliary engines or thrusters to carry out trajectory or attitude correction maneuvers. In the same way, space probes intended for the exploration of the solar system have thrusters that allow them to position themselves very precisely around a planet, or even to land on an asteroid in order to take samples of material from it.

As a general rule these thrusters, known as chemical or propellant thrusters, provide thrusts of a few Newtons at most by using liquid propellants such as hydrazine ($N_2H_2$) or hydrogen peroxide (oxygenated water). During the decomposition of these propellants, the chemical energy is converted into heat then into thrust during the expansion of the hot gases in a nozzle. The main drawbacks of these chemical thrusters are that their specific impulse is limited, that the propellants needed to operate them represent half of the total mass of the satellite and that their high propellant consumption limits the service life of the satellite.

In order to make it possible for space missions to go further and be of longer duration, recent years have seen the emergence of plasma thrusters which have the advantage over chemical thrusters that they provide greater specific impulses, significantly increase the mass of the payload compared with the mass of the propulsion system as well as the service life of the satellite. Their main drawbacks, as will be seen, are the lack of reliability of the ignition, in particular when the propellant gas pressure is low, their limited service life due to the ion bombardment of certain elements, and their miniaturization limitations for their use for example on miniature satellites. It should be noted that if their energy yield, although better than that of chemical thrusters, were improved, even further or longer missions could be envisaged.

Plasma thrusters can be classified in different ways according to whether their mode of igniting the plasma or the mode of accelerating the plasma towards the outlet of the nozzle is taken into consideration. It should be noted that these two criteria are relatively independent of one another and just as important as one another. In fact, the ignition mode determines the completeness of the ionization of the propellant gas and the reliability of this ignition, thus the reliability of the thruster, and can determine the size of the plasma discharge chamber, the space requirement, weight and energy yield of the thruster. With respect to the mode of accelerating the plasma, this determines the thrust, the specific impulse and the energy yield, and can determine the space requirement, weight and service life of the thruster.

If their mode of igniting the plasma is taken into consideration as the classification criterion, a first category of plasma thruster is the thruster known as an "arcjet" thruster, as described in patent application U.S. Pat. No. 5,640,843, the principle of which is the ignition of the plasma by an electric arc in the jet of propellant gas. The advantage of this category of thruster is that, all things being equal otherwise, it provides higher thrusts than other types of plasma thrusters, but it has the following major drawbacks: these thrusters have a low specific impulse compared with that of other plasma thrusters; consume a lot of electric current; have a limited service life due to the bombardment of the electrodes and of the internal walls of the discharge chamber by the ions and electrons which reach temperatures in the order of a few thousands to a few tens of thousands of degrees; require the excess heat to be evacuated into space, which results in a poor energy yield. Moreover, the ignition of plasma when the partial pressure of propellant gas is low lacks reliability.

According to this same criterion, a second category of plasma thruster is that of plasma thrusters that ignite their plasma solely by the resonance of an electromagnetic (EM) wave, often a microwave, in a discharge chamber containing a propellant gas to be ionized. The major drawback of the thrusters of this category is the relatively low energy yield since only a small fraction of the EM energy is absorbed by the plasma. Moreover, the ionization of the propellant gas is rarely complete, in particular when the propellant gas flow rate is high, and the ignition of the plasma lacks reliability when the partial pressure of propellant gas is low.

According to this same criterion, a third category of plasma thruster is that of plasma thrusters using "gyromagnetic resonance" of the magnetized free electrons of the plasma or ECR ("Electron Cyclotron Resonance"). As the application of a magnetic field to the plasma causes its free electrons to spin in one and the same determined direction and at one and the same determined frequency, the plasma can theoretically be ignited there, then sustained with an energy yield equal to 1 by the total absorption of an electromagnetic wave, the electric field of which rotates at the same speed and in the same direction as these magnetized electrons. In order to maximize this energy yield in practice, the length of the discharge chamber is substantially equal to an integer number of the half-wavelength of the electromagnetic wave in a vacuum, which poses the problem of miniaturization of the discharge chamber and therefore of the thruster. In fact, in order to be able to increase the resonance frequency of the EM wave while still having ECR conditions, it is necessary to increase correlatively the intensity of the magnetic field, which initially presupposes the use of powerful electromagnetic coils but the space requirement and weight of these coils runs counter to the objective of miniaturizing the thruster. This miniaturization problem is complicated moreover by the multiplicity of sources having to emit into the discharge chamber: propellant gas source, EM wave source and magnetic field source. Patent EP 0 505 327 describes such a thruster. Other technical fields also use ECR plasma sources, such as for example that of the production of integrated circuits. Patent application US 2005 0 287 describes an ECR ion source, equipped with electromagnetic coils, for ion implantation in microelectronics. The use of electromagnetic coils results in a significant weight and space requirement for a relatively low energy yield because of the losses by Joule effect, which is ill-suited to a use as a space thruster. Moreover, the ionization of the propellant gas is rarely complete, in particular when the propellant gas flow rate is high, and the ignition of the plasma lacks reliability when the partial pressure of propellant gas is low. Finally, these thrusters often suffer from the existence of parasitic plasma jets directed upstream known under the name ion pump effect.

Whatever the manner in which their plasma is ignited, plasma thrusters can also be classified according to the second criterion, which is the mode of accelerating the plasma in the nozzle.

According to this second criterion, a first family is that of plasma thrusters known as "electrostatic", which are characterized by the electrostatic nature of the force accelerating the plasma towards the outlet of the nozzle. This family can in turn be divided into three categories: accelerator grid thrusters, Hall effect thrusters and field effect thrusters.

The category of accelerator grid thrusters is characterized by the fact that the ions coming from a discharge chamber are accelerated by a system of electrically polarized grids. It should be noted that the ejected plasma is not electrically neutral. Accelerator grid thrusters have the following drawbacks, which limit their effectiveness and service life: the positive ion beams passing through the accelerator grid erode it, which limits the service life of these thrusters; the ejected ions recombine with the ejected electrons and generate obscuring deposits of material on the solar panels of the satellites on which they are fitted; the discharge chamber must have a large volume; the energy yield is relatively low because of plasma leaks at the walls of the discharge chamber and the accelerator grid; and the thrust is limited by the limitation of the density of the ions inside the grids due to the secondary electrons. Examples of accelerator grid thrusters are given in patent applications JP 01 310 179 and US 2004/161579 A1, in patent U.S. Pat. No. 7,400,096 B1, and in the article by MORRISON N. A. et al. "High rate deposition of ta-C:H using an electron cyclotron wave resonance plasma source", published in THIN SOLID FILMS, ELSEVIER-SEQUOIA S. A. LAUSANNE, C H, vol. 337, no. 1-2, 11 Jan. 1999 pages 71-73, XP004197099, ISSN: 0040-6090, DOI: 10.1016/S0040-6090 (98) 01187-0 and the article by NISHIYAMA K ET AL.: "Microwave power absorption coefficient of an ECR Xenon ion thruster", SURFACE AND COATINGS TECHNOLOGY, ELSEVIER, AMSTERDAM, NL, vol. 202, no. 22-23, 30 Aug. 2008 (2008-08-30), pages 5262-5265, XP025875510, ISSN: 0257-8972, DOI: 10.1016/J SURF-COAT.2008.06.069.

The category of Hall effect thrusters is characterized by a cylindrical anode and a negatively charged plasma. Hall effect thrusters use the drift of the charged particles in crossed magnetic and electric fields. Their drawbacks are, on the one hand, the presence of a continuous electric field which entails polarized electrodes and, on the other hand, the limitation in terms of plasma density which is linked to the formation of sheaths around these electrodes which oppose the penetration of the continuous electric field into the plasma, unlike the ultra high frequency field which easily penetrates into the ionized medium, hence the benefit of ultra high frequency (UHF) discharges. The document US 2006/290287 describes such a thruster.

The category of field effect thrusters is characterized by the ionization of a metallic liquid, its acceleration, then its electrical neutralization.

According to this second criterion, a second family is that of plasma thrusters known as "electromagnetic". This family can be divided into six categories: pulsed inductive thrusters, magnetoplasmadynamic thrusters, electrodeless thrusters, electrothermal thrusters, helicon double layer thrusters and μgradB thrusters.

The category of pulsed inductive thrusters is characterized by an acceleration for discontinuous time intervals.

The category of magnetoplasmadynamic thrusters is characterized by electrodes which ionize the propellant gas and generate in it a current which, in turn, generates a magnetic field which accelerates the plasma via the Lorentz force.

The category of electrodeless thrusters is characterized by the absence of electrodes, which eliminates a weak point for the service life of plasma thrusters. The propellant gas therein is ionized in a first chamber by an EM wave, then transferred into a second chamber where the plasma is accelerated by inhomogeneous and oscillating electric and magnetic fields that generate a force known as ponderomotive. Patent U.S. Pat. No. 7,461,502 describes such a thruster. A drawback of this category of thrusters is their use of electromagnetic coils to generate the oscillating magnetic field, because their space requirement, their weight and their loss of energy by Joule effect, which are all relatively high, are ill-suited to space applications.

The category of electrothermal thrusters is characterized by the heating of the plasma to temperatures in the order of a million degrees, then the partial conversion of this temperature into axial speed. These thrusters require high-power electromagnetic coils to generate very intense magnetic fields in order to be able to confine a plasma, the electrons of which have very high speeds because of their temperature. Besides the space requirement and the weight of these coils, their heat dissipation by Joule effect noticeably degrades the energy yield of these thrusters. Patent U.S. Pat. No. 6,293,090 describes such a thruster, more precisely it relates to a radio frequency (RF) thruster using a lower hybrid resonance (absorption of energy by coupling of a very low frequency UHF wave via a combined oscillation of the ions and the electrons of the plasma) of the VASIMR (Variable Specific Impulse Magnetoplasma Rocket) type, where the plasma is not heated by resonance of its electrons, as is generally the case for thrusters of this category, but by excitation of its ions by a high-power EM wave.

The category of helicon double layer thrusters is characterized by the injection of the propellant gas into a tubular chamber around which an antenna is wound which emits an electromagnetic wave of a power high enough to ionize the gas then generate, in the plasma created in this way, a helicon wave which further increases the temperature of the plasma.

The category of "μgradB" thrusters, also called "space charge field" thrusters, is characterized by the diamagnetic nature of their force. Chapter 5.1 of the book "Physique des plasmas, cours et application" by J.-M. Rax thoroughly explains the theory of the movement of an electron excited by a UHF electromagnetic field in a static or slowly variable magnetic field. On page 152, in particular, the presence is described of a convergence or a divergence of the induced field lines and therefore of a force in the direction of this field, proportional to the μ magnetic moment and to the gradient of this magnetic field. This force is called "μgradB" or diamagnetic force. The thruster that forms the subject of the present patent application is effectively based on entirely "conventional" physical principles explained in the course of this chapter, the adiabaticity hypotheses mentioned on page 153 for the invariance of the μ magnetic moment being largely satisfied in the case of the invention. This book does not, however, disclose how to design a plasma thruster sustaining the plasma by ECR, the size of which can be reduced relative to the half-wavelength of the electromagnetic wave and the reliability of the ignition of which is improved even under conditions where the partial pressure of propellant gas is very low. The article by STALLARD B. W. ET AL.: "Whistler-driver, electron-cyclotron-resonance-heated thruster: experimental status", JOURNAL OF PROPULSION AND POWER 1996 July-August AIAA, vol. 12, no. 4, July 1996 (1996-07), pages 814-816, XP008133752 describes a diamagnetic force thruster, the plasma of which is ignited and sustained by electron waves generated by an EM wave, with a frequency lower than the gyromagnetic frequency, emitted by two helically coiled antennas, and by a magnetic field, generated by electromagnetic coils, with an intensity greater than the ECR intensity. The propellant gas is injected into a zone where the magnetic field has decreased below the ECR intensity. It raises the problem of the incomplete ionization of the propellant gas of this thruster. In order to limit this incompleteness of this ionization, the gas chamber is segmented. Despite this precaution, although it is explained that the ionization becomes more complete when the gas flow rate decreases, it remains incomplete even for low flow rates. Nor is any disclosure made with respect to improving the reliability of the ignition for very low flow rates of propellant gas or means of reducing the size of this thruster.

None of the plasma thrusters of the state of the art combine, at the same time, the advantages of a reliable ignition (systematic and instantaneous ignition) and a complete ionization under all electromagnetic wave power and propellant gas flow rate operating conditions, in particular for very low flow rate and very low propellant gas partial pressure; the absence of a parasitic plasma jet directed upstream; a discharge chamber with a reduced size relative to the half-wavelength of the EM wave used to sustain the plasma; the ability to operate at magnetic field intensities that allow the use of permanent magnets, thus avoiding the space requirement, the weight and the losses by Joule effect of electromagnetic coils; making possible a controlled variation of the thrust and of the specific impulse; the ability to achieve an energy yield close to 1; accelerating a neutral plasma, thus not needing to be neutralized; and the service life of which is not limited by the wear of parts by the plasma nor by the depositing of propellant gas on the solar panels.

SUMMARY OF THE INVETION

The aim of the present invention is to produce a thruster capable of having an energy yield close to 1, such as thrusters using ignition by ECR, and of being smaller in size than the thrusters of the state of the art using ignition by ECR. As will be seen in the following description, the inventors will state that this thruster combines all the above-mentioned advantages, in particular thanks to the implementation of a new type of ignition of the plasma resulting from the coming together of the particular geometric configurations of the magnetic field lines, the injection of propellant gas and the EM wave emission.

The principle of the invention is to reduce the size of an ECR plasma thruster, on the one hand by reducing the length of its discharge chamber and on the other hand by injecting the propellant gas by means of the antenna emitting the EM wave, the reduction in the length of the discharge chamber being achieved by the use of an electron resonance plasma zone, confined by a magnetic field, as resonant cavity of the EM wave, since the refractive index of the ECR plasma is 5 to 10 times greater than that of the discharge chamber used in the state-of-the-art plasma thrusters as resonant cavity of the EM wave.

More precisely, the invention relates to a plasma thruster comprising a discharge chamber comprising an internal cavity and an outlet opening; at least one injection means comprising an injection nozzle capable of injecting into the discharge chamber a propellant gas along a predefined axis; said injection nozzle having an outlet end; a magnetic field generator capable of setting electrons of the propellant gas present in the discharge chamber in gyromagnetic rotation; and an electromagnetic wave generator capable of irradiating the propellant gas present in the discharge chamber by generating at least one electromagnetic wave the electric field of which has a right-hand circular polarization and a frequency equal to the frequency, $f_{ECR}$, of gyromagnetic resonance of the electrons of the propellant gas magnetized by said magnetic field generator, characterized in that:

said magnetic field generator is capable:

on the one hand, of generating a magnetic field having:

a first local maximum of intensity inside the injection nozzle and at the outlet end of the injection nozzle;

field lines which determine an iso-field surface, known as the "ECR surface", with an intensity equal to that allowing a cyclotron resonance of the electrons under the effect of said electromagnetic wave, said ECR surface enveloping the outlet end of said injection nozzle, the volume delimited by this ECR surface being the resonant cavity of the electromagnetic wave;

a second local maximum of the intensity of the magnetic field inside the injection nozzle, separated from the first local maximum by a local minimum of the intensity of the magnetic field inside said injection nozzle;

on the other hand, of giving said field lines the shape of a nozzle, so as to generate a diamagnetic propulsion force;

said injection means:

is produced from an electrically conductive material and is electrically connected to the electromagnetic wave generator so as to also operate as an electromagnetic antenna emitting said electromagnetic wave into the propellant gas at the outlet of said injection nozzle;

is produced from a magnetically conductive material, making it possible to achieve, inside the latter, said second local maximum of the intensity of the magnetic field;

comprises, at the downstream end of said injection nozzle, an injection channel with an external diameter of less than a few millimeters.

It is noted that said local minimum of intensity of the magnetic field functions as an electron trap which will make it possible to ignite the plasma by microhollow cathode discharge even at very low pressure.

Also noted is the importance of the shape of the magnetic field lines which result in the ECR surface being positioned exactly at the outlet (at a distance in the order of millimeters) of the nozzle for injecting the propellant gas ionized by microhollow cathode discharge. This position contributes to the fact that all of the neutral gas exiting the injection nozzle is ionized by passing through the ECR surface.

It is also noted that the injection of the propellant gas and of the electromagnetic (EM) wave through the same means makes it possible on the one hand to have a more compact discharge chamber and on the other hand to guarantee that the EM wave irradiates a zone where the gas density is maximal, which maximizes the level of ionization of the neutral gas exiting the injection nozzle, which was one of the problems of the "μgradB" thruster described by STALLARD B. W. ET AL.

Finally, it is noted that the coming together of the positions of the EM wave emission antenna and the ECR surface makes it possible to concentrate the irradiation into the volume delimited by the ECR surface where the EM wave returns to resonance, which maximizes the absorption of the EM energy by the plasma and therefore maximizes the energy yield of the thruster.

According to particular embodiments, the plasma thruster comprises one or more of the following features:

Plasma thruster according to the previous embodiment, in which the magnetic field generator comprises as magnetic field source at least one permanent magnet with a toric shape arranged coaxially to the predefined axis and having a first magnetic pole and a second magnetic pole, a first magnetic element integral with the first magnetic pole and a second magnetic element integral with the second magnetic pole, said first and second magnetic poles being arranged at a first distance and, respectively, a second distance from the predefined axis; the second distance being longer than the first distance, the first magnetic pole and the second magnetic pole being arranged upstream and, respectively, downstream of the injection nozzle with respect to the direction of flow of the propellant gas, the field lines intersecting with the injection nozzle and forming an angle comprised between 10° and 70° with said predefined axis.

Plasma thruster (according to one of the previous embodiment, in which the length, defined along the predefined axis, of the internal cavity of the discharge chamber is 5 to 10 times smaller than the half-wavelength of said electromagnetic wave in a vacuum, the discharge chamber having an internal cross-sectional area comprised between 0.7 square centimeters and 30 square centimeters; in which the central injection channel has an internal cross-sectional area comprised between 0.7 square millimeters and 3 square millimeters.

Plasma thruster according to one of the previous embodiment, in which the magnetic field intensities of said first local maximum, local minimum and second local maximum are, respectively, approximately 0.18 tesla, 0.01 tesla and 0.05 tesla.

Plasma thruster according to one of the previous embodiment, in which said electromagnetic wave is capable of propagating along an axis parallel to the predefined axis and in which, at the predefined axis, the magnetic field gradient is parallel to the predefined axis; said magnetic field gradient being negative from upstream to downstream in a direction defined by the direction in which the propellant gas is ejected.

Plasma thruster according to one of the previous embodiment, which comprises a device for modulating the power of the electromagnetic wave and a device for controlling the flow rate of the propellant gas, said power of the electromagnetic wave being comprised between 0.5 watts and 300 watts, and preferably between 0.5 watts and 30 watts in a first operating mode.

Plasma thruster according to one of the previous claims, which comprises, on the one hand, a circulator, arranged at the outlet of said electromagnetic wave generator and, on the other hand, an electrically conductive cylindrical sleeve, arranged downstream of the plane defined by the outlet opening known as the outlet plane of the plasma thruster, the diameter of which is substantially equal to one quarter of the wavelength of the electromagnetic wave and the length of which is substantially equal to three quarters of the wavelength of the electromagnetic wave.

The benefit of the sleeve is explained below. As the "μgradB" plasma thruster comprises an open cavity with dimensions much smaller than the incident wavelength, a significant loss of power linked to the diffraction of the EM wave in the orifice and radiation to the outside of the engine could, in the absence of a sleeve, occur in the engine ignition phase.

Moreover, in the absence of a sleeve, only the fraction of the EM wave that corresponds to the right-hand circular polarization would be used for the ECR with the plasma inside the engine, the rest of the EM wave returning to the EM generator or radiating to the outside by diffraction in the outlet orifice. The presence of a sleeve characterized as above makes it possible for all of the EM power reaching the sleeve to be reflected towards the inside of the engine, then allowing the portion that returns to the generator to be sent back again to the cavity of the thruster by means of said circulator arranged at the outlet of said EM generator. When it enters the cavity, a fraction of the power reflected by the circulator is, in turn, right-hand circularly polarized and absorbed by the ECR plasma, the fraction of EM wave not absorbed at this stage again undergoing the same circulation cycle until all of the EM energy has been absorbed by the ECR plasma. The combination of such a sleeve coupled with such a circulator makes it possible to achieve an energy yield close to unity in all the operating configurations of the thruster. It is noted that a sleeve can be produced from a fine metallic mesh, and can therefore be light.

Plasma thruster according to one of the previous embodiment, comprising two injection means coaxial to the axis, one supplying gas to be ionized to the ECR surface and the other increasing the thrust via a gas flow rate and an arcjet operation.

The invention concerns also a method for generating a propulsion thrust by means of a plasma thruster comprising the following steps:

- injection, into a discharge chamber comprising an internal cavity and an outlet opening, using at least one injection means comprising an outlet end called the injection nozzle, of a propellant gas along a predefined axis;
- generation, using a magnetic field generator, of a magnetic field capable of setting electrons of the propellant gas present in the discharge chamber in gyromagnetic rotation;
- emission into the propellant gas present in the discharge chamber, using an electromagnetic wave generator, of at least one electromagnetic wave the electric field of which has a right-hand circular polarization and a frequency equal to the gyromagnetic resonance frequency, $f_{ECR}$, of the electrons of the propellant gas magnetized by said magnetic field generator;
- ignition of the plasma by ionization of the propellant gas;
- sustaining of the plasma by cyclotron resonance of the electrons;

characterized in that:

- the ignition of the plasma is realized by microhollow cathode discharge using the injection means which is made of magnetic material and comprises, at the downstream end of its injection nozzle, an injection channel with an external diameter of less than a few millimeters;
- the injection of the propellant gas and the emission of the electromagnetic wave are carried out by one and the same injection means and at the same location in the discharge chamber, said injection means being produced from an electrically conductive material and electrically connected to the electromagnetic wave generator in order to emit the electromagnetic wave into the propellant gas at the outlet of the gas from said injection nozzle, so as to maximize the level of ionization of the propellant gas on exiting;
- said magnetic field generation is such that:
  - on the one hand, the magnetic field has:
    - a first local maximum of intensity situated inside the injection nozzle and at the outlet end of the injection nozzle;
    - field lines which determine an iso-field surface, known as the ECR surface, with an intensity equal to that allowing a cyclotron resonance of the electrons under the effect of said electromagnetic wave, said ECR surface enveloping the outlet end of said injection nozzle;

a second local maximum of the intensity of the magnetic field inside the injection nozzle, separated from the first local maximum by a local minimum of the intensity of the magnetic field inside said injection nozzle;

on the other hand, the magnetic field gives said field lines the shape of a nozzle, so as to generate a diamagnetic force;

the sustaining of the plasma by cyclotron resonance of the electrons being realized by resonance of the electromagnetic wave in the volume delimited by the ECR surface so as to take advantage of the high refractive index in this volume to reduce the length of the discharge chamber and consequently the plasma thruster.

It is noted that the ignition of the plasma is not realized by ECR, as is usually the case in the diamagnetic force thrusters of the state of the art, but by microhollow cathode discharge. Once the plasma has been ignited and positioned in the volume known as the ignition volume at the outlet of the injection nozzle, this plasma is set in ECR via the electromagnetic wave, which multiplies its refractive index by a factor of 5 to 10 and then makes it possible to use this volume as resonant cavity of the electromagnetic wave, thus increasing the energy yield. This refractive index of the resonance medium of the EM wave, higher than in the state of the art, makes it possible on the one hand to reduce the length of the discharge chamber, since igniting the plasma and sustaining it no longer require that the length of the discharge chamber be equal to an integer number of the half-wavelength of the EM wave in a vacuum, and on the other hand to use a magnetic field with a lower intensity, achievable with simply a permanent magnet, since a lower frequency of the EM wave can be used.

The ignition of the plasma by microhollow cathode discharge provides a systematic and almost instantaneous ignition whatever the operational conditions, in particular of gas flow rate and of EM power, and therefore clearly increases the reliability of the thruster. The thruster according to the invention therefore belongs to a new category of plasma thruster.

Advantageously, the method according to the previous embodiment, wherein the plasma thruster moreover comprises a device for modulating the power of the electromagnetic wave, a device for controlling the gas flow rate, a peripheral injection channel capable of injecting the propellant gas into the discharge chamber; and in which the method comprises the following steps:

injection of propellant gas into the discharge chamber via the peripheral injection channel;

regulation of the flow rate of propellant gas injected into the discharge chamber via the peripheral injection channel;

modulation of the power of the electromagnetic wave.

BRIEF DESCRIPTION OF THE DRAWINGS

The invention will be better understood on reading the following description, given by way of example only, and with reference to the drawings, in which.

DETAILED DESCRIPTION OF THE INVENTION

Figure 1:
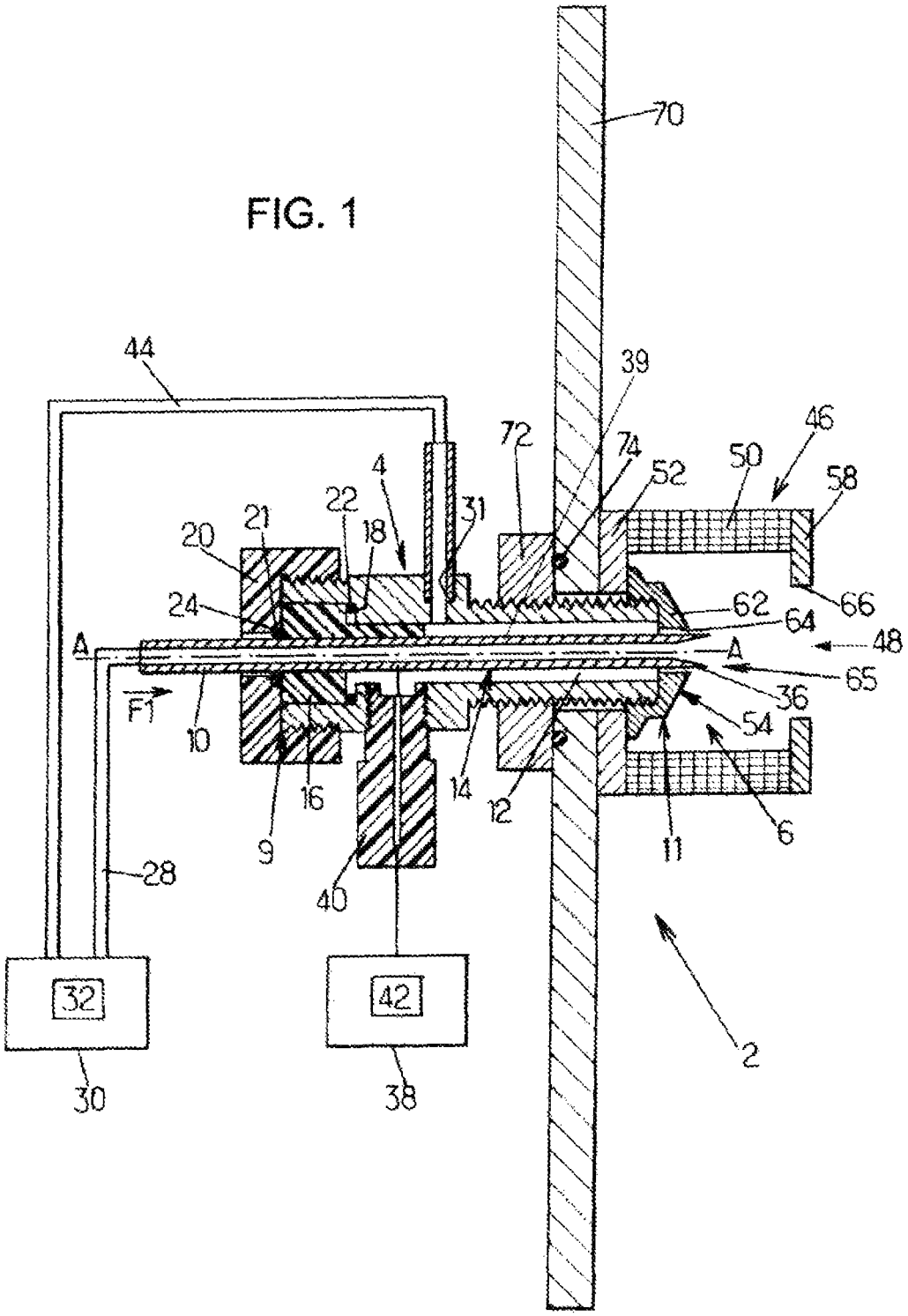
FIG. 1 is an axial cross-sectional view of a plasma thruster according to the invention.

With reference to FIG. 1, the plasma thruster 2 according to the invention comprises a support body 4 supporting a discharge chamber 6 leading to an outlet opening 48.

The support body 4 is a non-magnetic hollow body open at each of its ends 9, 11. It comprises a cylindrical internal cavity 14 with an axis of rotation A-A, hereinafter called the predefined axis A-A.

This cavity 14 comprises a central injection channel 10 coaxial to the predefined axis A-A. This central injection channel 10 is constituted for example by a magnetic metal pipe. It has an external diameter smaller than the diameter of the cavity 14, such that with the support body 4 it forms a peripheral injection channel 12 arranged between the internal wall of the support body 4 and the external wall of the central injection channel 10.

In particular, the central injection channel 10 has an internal diameter comprised between 0.5 and 2 mm, and preferably comprised between 1 mm and 1.5 mm. The peripheral injection channel 12 has an external diameter comprised between 3 and 20 mm, and preferably comprised between 6 mm and 12 mm, the internal diameter of the peripheral injection channel 12 being the external diameter of the central injection channel 10.

In other words, the central injection channel 10 has an internal cross-sectional area comprised between 0.7 square millimeters and 3 square millimeters. As a variant, the central injection channel 10 and the peripheral injection channel 12 have a square cross-section.

The central injection channel 10 is fixed to the support body 4 via an insulation block 16 and a clamping ring 20. In particular, a portion of the central injection channel 10 is fitted into a through hole of the insulation block 16. The insulation block 16 is arranged and fixed in the cavity 14 between a shoulder 18 of the support body 4 and a bearing surface 21 of the clamping ring 20. The clamping ring 20 is screwed onto the outer edge of the end 9 of the support body 4.

A first O-ring 22 is interposed between the insulation block 16 and the shoulder 18. A second O-ring 24 is interposed between the insulation block 16 and the bearing surface 21 of the clamping ring 20.

The central injection channel 10 and the peripheral injection channel 12 form two means of injecting propellant gas into the chamber 6, in the context of the invention.

For this purpose, one end of the central injection channel 10 is connected, by a pipe 28, to a propellant gas source 30. An opening 31 is arranged in the support body 4. This opening 31 leads to the peripheral injection channel 12. This opening 31 is connected by a pipe 44 to the propellant gas source 30 in order to supply the peripheral injection channel 12 with propellant gas, during operation of the plasma thruster in a second operating mode known as the "arcjet" operating mode, as described hereinafter.

This source 30 is equipped with a device 32 for controlling the flow rate of the gas.

In a first operating mode known as the "conventional" operating mode, the flow rate of the propellant gas is comprised between 0.1 grams per hour and 40 grams per hour.

In a second operating mode known as the "arcjet" operating mode, the flow rate of the propellant gas is comprised between 1 gram per hour and 400 grams per hour, and preferably comprised between 10 grams per hour and 400 grams per hour.

The other end of the central injection channel 10 comprises a pointed end 36, for example, formed by a beveling of the annular rim of the channel.

The pointed end 36 extends outwards from the support body 4, into the discharge chamber 6. It contributes to the ionization of the propellant gas by an effect called "point discharge". Point discharge makes it possible to concentrate the magnetic field into a volume of the discharge chamber, called the ignition volume. It is not a discharge by corona ionization, which concentrates the lines of the electric field, but a microhollow cathode discharge between the two above-mentioned intensity maxima of the magnetic field in the immediate proximity of an outlet of an injection nozzle.

It is to be noted that the presence of a local maximum of the intensity of the magnetic field in the ignition volume, and therefore inside the injection tube, is possible for two reasons. Firstly because the present diamagnetic force thruster constitutes an open cavity for the magnetic field, or more precisely a coaxial system open at one end. Secondly because the complex magnetic circuit of the thruster comprises parts the role of which is precisely to channel a large portion of the magnetic field into this volume via in particular the injection channel 10 made of magnetic material and above all via its pointed end 36.

In the present example, the ignition volume is comprised between 0.5 $mm^3$ and 5 $mm^3$. It is arranged 12 mm to 15 mm downstream of the pointed end 36 of the central injection channel 10.

The central injection channel 10 is, moreover, suitable for emitting electromagnetic waves, in particular microwaves. For this, the central injection channel 10 is produced from an electrically conductive material and is electrically connected to an electromagnetic wave generator 38 via a connector 40 fixed, for example by screwing, to the support body 4. The connector 40 is, for example, an SMA (registered trade mark) type connector.

The electromagnetic wave generator 38 is capable of irradiating the propellant gas present in the discharge chamber 6 with at least one electromagnetic wave, the electric field of which rotates in the same direction and at the same frequency as the magnetized electrons of the propellant gas, so as to achieve a total absorption of the electromagnetic energy by the ECR electrons. More precisely, the electric field has a right-hand circular polarization and a frequency equal to the gyromagnetic resonance frequency of the electrons of the propellant gas magnetized by the magnetic field generator.

The electromagnetic field generator 38 is equipped with a device 42 for modulating electromagnetic power. It is suitable for generating electromagnetic waves with a power comprised between 0.5 and 300 watts, and preferably comprised between 0.5 and 30 watts in a first operating mode known as the "conventional" operating mode, and electromagnetic waves with a power comprised between 50 and 500 watts, and preferably comprised between 200 and 500 watts in the second operating mode known as the "arcjet" operating mode.

The power of the electromagnetic waves is great enough to achieve ECR and to eject the electrons before they have time to radiate, but not too high, so as to prevent any radiation of these electrons before ejection, which makes it possible to prevent any heating by radiation and to preserve an optimum energy yield. The electromagnetic power that the thruster can absorb without degrading the energy yield is linked to the size of the Larmor radius Rb of the electrons in the plasma. This must remain substantially smaller than the radius of the cavity in order that the electrons do not at any time strike the internal wall of the thruster (plasma known as "magnetic levitation" plasma). However, for an electron with an electric charge qe and a mass me, in a magnetic field B0 in the order of 0.1 tesla (1000 gauss), a radius of gyration Rb of 1 millimeter would correspond to a speed of the electrons $ve=Rb.qe.B0/me=1.76\times10^7$ m/s in a direction perpendicular to the magnetic field. Expressed in electron volts, the kinetic energy corresponding to the spin of the electrons would then be in the order of $0.92\times10^5$ eV. Compared with the ionization energy of the gas in the order of 10 to 20 eV for example, such a limit would seem to be difficult to achieve with the electromagnetic powers of a few tens to a few hundreds of watts which are involved here.

It will also be noticed that in an adiabatic process the acceleration of the electrons in the nozzle preserves the μ magnetic moment$=qe^2$. $Rb^2$ B0/2 me. A decrease in B0 by a factor of 10 for example therefore would only cause an increase by a factor of about 3 in the electron gyration radius Rb.

Finally, if a much greater electromagnetic power had to be used, it is possible, without increasing its dimensions, to increase the upper operating limit of the engine, by correlatively increasing the magnetic field B0 and the frequency of the EM exciter wave. Magnets about ten times more powerful than those used in our experiments are already commercially available.

The discharge chamber 6 comprises a magnetic field generator 46 fixed, for example by screwing, to the end 11 of the support body 4. This generator 46 comprises a magnetic field source 50 having two poles, a washer 52 integral with an end surface constituting a pole of said source 50, a retaining nut 54 in contact with the washer 52, and a washer 58 integral with an end surface constituting the other pole of said source 50.

The discharge chamber 6 moreover comprises an outlet opening 48 for the plasma.

The magnetic field source 50 is constituted, for example, by a permanent magnet with a toric shape coaxial to the predefined axis A-A. To simplify the description, it is hereinafter called magnet 50.

The magnetic field emitted by the magnet 50 has an intensity comprised between 0.05 tesla and 1 tesla, and preferably comprised between 0.085 tesla and 0.2 tesla.

The washer 52 and the retaining nut 54 form a first magnetic element and the washer 58 forms a second magnetic element in the context of the invention.

The washers 52, 58 are each integral with an annular face of the magnet 50. The washer 52 moreover is fixed, for example by screwing, on the outer periphery of the end 11 of the support body.

The retaining nut 54 comprises a substantially truncated protuberance 62 the axis of rotation of which is the predefined axis A-A. The protuberance 62 extends towards the central injection channel 10.

The washer 52, the retaining nut 54 and the washer 58 are constituted by paramagnetic steel, and preferably by ferromagnetic steel.

Figure 2:
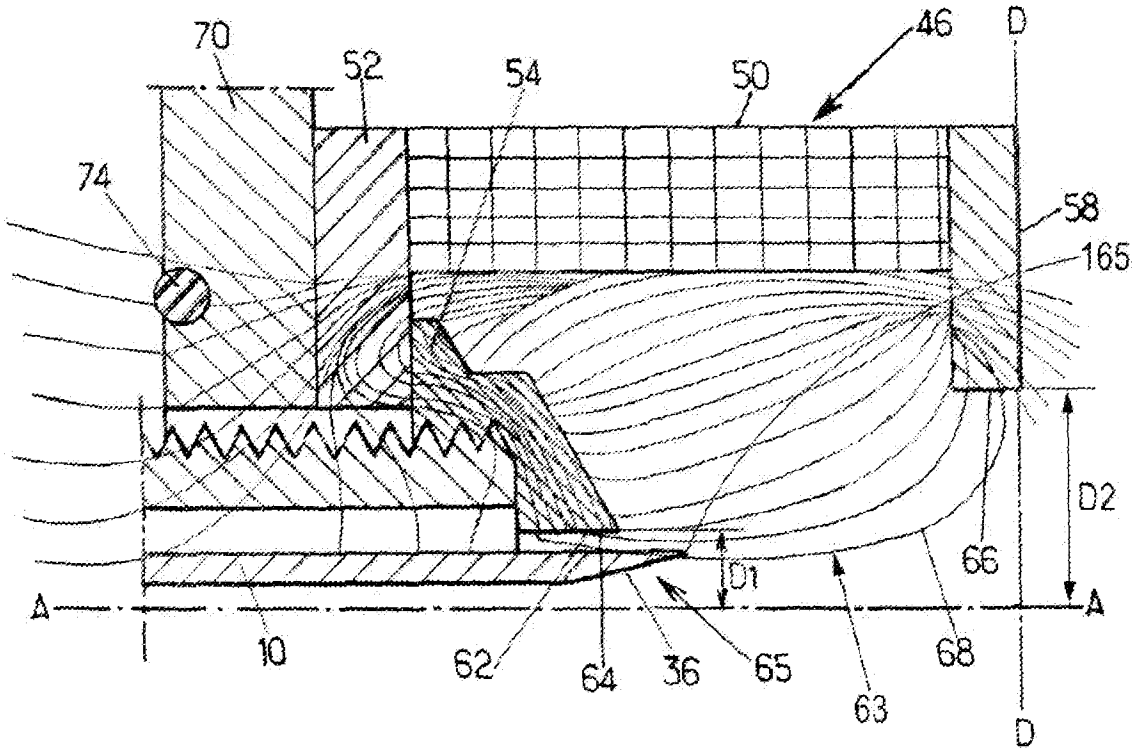
FIG. 2 is an enlarged view of part of FIG. 1 showing the field lines of the magnetic field generated by a generator of the plasma thruster according to the invention.

With reference to FIG. 2, as the washer 52 and the retaining nut 54 are suitable for guiding the magnetic field emitted by the permanent magnet 50, the end surface of the protuberance 62 closest to the central injection channel 10 forms a first magnetic pole 64 arranged upstream of the injection nozzle 65 with respect to the direction F1 of flow of the propellant gas, and at a first distance D1 from the predefined axis A-A.

As the washer 58 is also suitable for conducting the magnetic field, the end surface of the washer 58 closest to the central injection channel 10 forms a second magnetic pole 66 arranged downstream of the injection nozzle 65 of the central injection channel, with respect to the direction F1, and at a second distance D2 from the predefined axis A-A; said second distance D2 being longer than the first distance D1.

The field lines 68 of the field emitted by the magnetic field generator 46 are in the shape of a nozzle. They intersect with the injection nozzle 65 of the central injection channel 10 and form an angle comprised between 10° and 70° with the predefined axis A-A. In other words, the magnetic field emitted by the magnetic field generator 46 is divergent. At the level of the predefined axis A-A, the magnetic field gradient is parallel to the predefined axis A-A. Moreover, this magnetic field gradient is negative from upstream to downstream with respect to the direction in which the propellant gas is ejected.

The magnetic field moreover has a first local maximum of intensity of the magnetic field at the injection nozzle 65 of the central injection channel. This intensity is sufficient to completely ionize, by ECR, the propellant gas exiting said injection nozzle 65. This intensity is for example comprised between 0.087 tesla (ECR for a microwave frequency of 2.45 GHz), and approximately 0.5 tesla (upper limit that can be achieved with permanent magnets). The particular shape of the field lines 68 results in the ECR surface being very close to said first local maximum of intensity and in this ECR surface enveloping the outlet end 165 of the injection nozzle 65. For an EM wave frequency of 2.45 GHz, the ECR surface is situated at a distance in the order of millimeters downstream of the outlet end 165.

In this patent application, a region of space where the gyration frequency of the free electrons in the local magnetic field is substantially equal to the frequency of the electromagnetic exciter wave is called the "ECR surface".

The magnetic field generator 46 moreover is capable of accelerating, by a diamagnetic force, the plasma ignited at the injection nozzle 65 towards the outlet opening 48, said plasma ejected from said thruster being electrically neutral. It is to be noted that one of the main benefits of ECR plasma sources resides in the possibility of acting only on the free electrons of the plasma and not on the ions, which requires only relatively reduced magnetic fields, of approximately 0.1 tesla (1000 gauss) in our example. The electrical neutrality of the plasma is very effectively ensured by the ambipolar electric field, or space charge field, which immediately appears within the plasma and counters any imbalance between the populations of positive ions and electrons. It is therefore not necessary to use a neutralizer. In the absence of an electric field applied by an optional accelerator grid, the ambipolar electric field is not disrupted and the electrons subjected only to the diamagnetic force will then entrain in their movement the non-magnetized positive ions (hence the "diamagnetic" nature of the plasma). Reciprocally, on exiting the thruster, the electrons connected to the ions by the space charge will be able to escape from the residual magnetic field because of the inertia of these previously accelerated ions inside the thruster. Contrary to the other thrusters of the state of the art, the acceleration of the plasma in the magnetic nozzle therefore does not require the consumption of additional electric power in the case where, as in this example, the magnetic nozzle is generated by simple permanent magnets. This saving on electric power is a significant advantage for a space application.

The central injection channel 10 leads to the start of the divergent portion of the magnetic field, upstream of the ECR zone.

Advantageously, the central injection channel 10 serves both as microwave emission antenna 39 inside the discharge chamber 6 and as injection nozzle 65 for injecting the gas to be ionized. The injection nozzle 65 comprises an outlet end 165.

The magnet 50, the washer 52, the retaining nut 54 and the washer 58 form the discharge chamber 6. This has a diameter comprised between 6 mm and 60 mm, and preferably comprised between 12 mm and 30 mm. The discharge chamber 6 thus has an internal cross-sectional area comprised between 0.7 square centimeters and 30 square centimeters.

The length, defined along the predefined axis A-A, of the internal cavity 14 of the discharge chamber 6 is 5 to 10 times smaller than the half-wavelength in a vacuum of the electromagnetic wave emitted by the electromagnetic wave generator 38.

Advantageously, the discharge chamber has a very small dimension.

The plasma thruster 2 comprises, moreover, a mounting clamp 70 and a lock nut 72 screwed onto the outer edge of the support body 4. An O-ring 74 is moreover arranged between the mounting clamp 70 and the lock nut 72.

Advantageously, the plasma thruster according to the invention can be used by means of permanent magnets that do not consume energy.

Advantageously, the discharge chamber forms a high-frequency resonant cavity having dimensions in the order of centimeters with a relatively low frequency in the order of 2.3 to 2.8 GHz. This is possible because the optical index of the ECR plasma is very high, which makes it possible to have a relatively short wavelength even with a relatively low frequency. As the ECR frequency is proportional to the magnetic field, a cavity of this size is therefore possible even with a magnetic field in the order of 0.08 to 0.1 T, which can easily be produced by annular permanent magnets with small dimensions.

Figure 3:
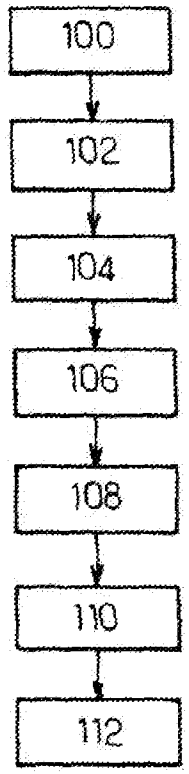
FIG. 3 is a diagram of the steps of the method according to the invention.

The method for generating a propulsion thrust according to the invention is realized by means of a plasma thruster described above. In the first operating mode known as "conventional", it comprises, with reference to FIG. 3, the following steps:

- generation 90 of a magnetic field 63;
- emission 100 of the microwaves by the electromagnetic wave generator 38;
- injection 104 of the propellant gas into the discharge chamber 6 via the central injection channel 10;
- ignition 101 of the plasma;
- sustaining 103 of the plasma by ECR
- modulation 102 of the power of the electromagnetic wave emitted by the electromagnetic wave generator 38, by the modulation device 42;
- regulation 106 of the propellant gas flow rate in the central injection channel 10 by the control device 32.

Advantageously, the emission step 100 is implemented before the injection step 104 when the user desires to save on propellant gas, and the injection step 104 is implemented before the emission step 100 when the user desires to save on electricity.

In the second operating mode known as "arcjet", it moreover comprises the following steps:

injection 108 of additional propellant gas via the peripheral injection channel 12;

regulation 110 of the propellant gas flow rate in the peripheral injection channel 12 by the control device 32; and modulation, with the modulation device 42, of the power of the microwaves emitted by the electromagnetic wave generator 38, in order to operate in the second operating mode known as "arcjet".

Advantageously, the axial injection of the propellant gas is completed in this operating mode by an injection of gas around the central injection pipe. This is generally used during a temporary operation with a strong thrust of the thruster, called here the second operating mode known as "arcjet". In this case, the rise in pressure of the discharge chamber 6 makes it possible to ignite therein a plasma of the electric arc type—very dense and very hot under the effect of the injection of high-power microwaves (greater than a hundred watts). This makes it possible to operate the plasma thruster with much greater thrusts—in the order of several hundreds of millinewtons, but for a much greater heat dissipation and a more reduced energy yield.

Advantageously, it is possible to optimize, for example over the whole of the mission, the consumption both of gas and of energy, by taking advantage of a regulating range for the gas flow rate in the central injection channel and a regulating range for the power of the electromagnetic waves, the two causing the specific impulse and the thrust of the thruster to vary differently, and, where appropriate, by taking advantage of a regulating range for the gas flow rate in the peripheral channel and a regulating range for the power of the electromagnetic waves.

Advantageously, it is possible to use each propulsion mode independently or in combination, a combination making it possible, for example, to realize fine adjustments of the total thrust, even for high amplitudes of this thrust.

Figure 4:
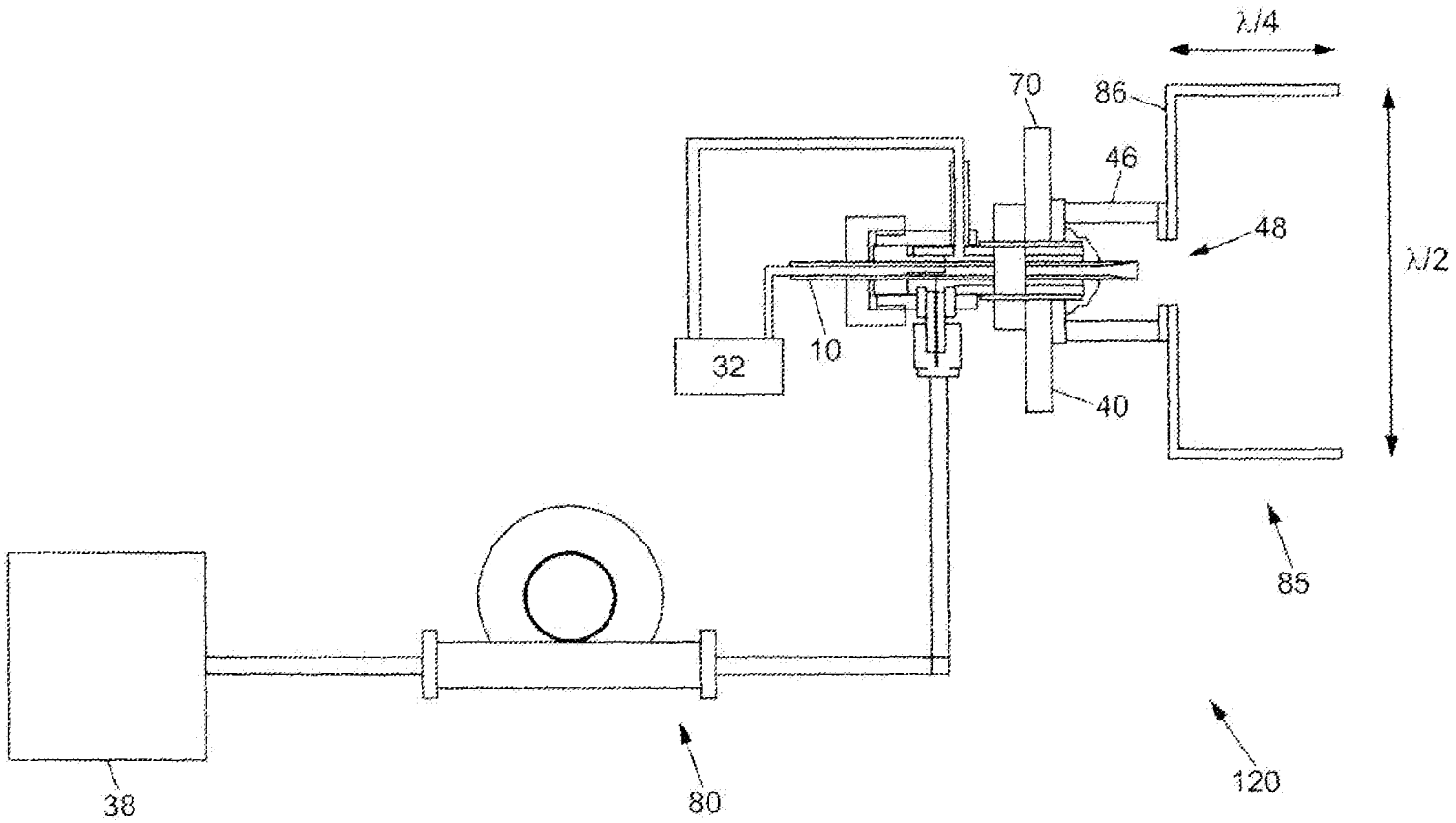
FIG. 4 is an axial cross-sectional view of a thruster according to a variant embodiment of the invention.

According to the variant embodiment shown in FIG. 4, the plasma thruster 120 moreover comprises, on the one hand, a circulator 80 connected to the electromagnetic wave generator 38 and to the connector 40 screwed onto the support body 4 and, on the other hand, an electrically conductive cylindrical sleeve 85, arranged downstream of the outlet plane of the plasma thruster 120.

The circulator 80 is a device, generally made of ferrite, which is placed in a microwave circuit in order to protect the electromagnetic generator 38 or an optional amplifier against a return of EM waves, for example reflected by the plasma (which is the charge to be irradiated, for the EM wave generator). The flow of EM waves which passes through the circulator 80 in the direction of the plasma is not absorbed by the circulator. The flow reflected in the direction of the EM wave generator rotates in the circulator 80 and leaves again in the direction of the plasma, such that the electromagnetic generator 38 is protected and there is no loss of flow of EM waves by reflection directed upstream.

The sleeve 85 has a diameter larger than the diameter of the permanent magnet 50 and a rim 86 fixed against the washer 58 of the magnetic field generator 46. In particular, the sleeve 85 is, for example, a circular wave guide segment with a diameter equal to ½ wavelength and with a length equal to ¼ or ¾ wavelength of the EM wave in a vacuum. The sleeve 85 blocks the propagation of the EM wave which would otherwise radiate into free space by diffraction from the outlet opening of the thruster. Instead of being emitted into free space, the flow of ultra high frequency EM waves is thus reflected towards the plasma inside the thruster and the portion of it not absorbed by the plasma is sent to the circulator 80. The circulator 80 then, in turn, returns this reverse flow to the plasma thruster 120, and so on until the absorption of the flow of EM waves by the plasma is complete.

Figure 5:
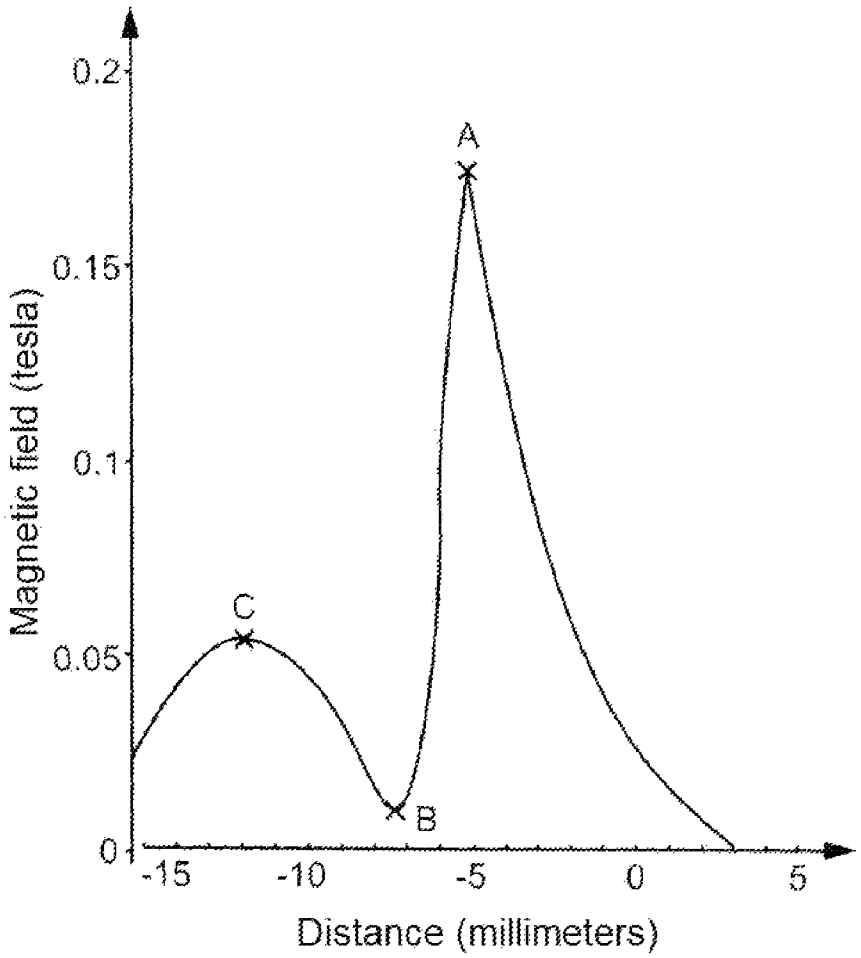
FIG. 5 is a graph showing the magnetic field along the axis A-A of the thruster.

FIG. 5 represents the variation of the magnetic field generated by the generator 46 relative to the distance from the outlet plane D-D of the plasma thruster along the predefined axis A-A. In this figure the zero of the X-axis defines the outlet plane D-D. As can be seen in FIG. 2, the outlet plane is the plane parallel to the central plane of the mounting clamp 70 situated at the outlet opening 48.

As can be seen in this figure, the magnetic field has a first local maximum, A, and a second local maximum, C, situated inside the injection nozzle 65, as well as a local minimum situated between the first local maximum A and the second local maximum C.

The first local maximum A is situated at the outlet end 165 of the injection nozzle 165. The first local maximum A is sufficient to ionize, by cyclotron resonance of the electrons of the propellant gas under the effect of said electromagnetic wave, the propellant gas exiting said injection nozzle 65.

The first local maximum A has an intensity greater than the threshold value $B_{ECR}$ needed to achieve cyclotron resonance defined by the following formula:

$$B_{ECR}=2*\pi*f_{ECR}me/qe,$$

in which me is the mass of an electron, qe is the electric charge of an electron, $f_{ECR}$ is the gyromagnetic resonance frequency.

The magnetic field generator 50 is capable of accelerating, towards the outlet opening 48 by the diamagnetic force, the free electrons of the plasma ignited at the injection nozzle (65), the positive, non-magnetized, ions following these free electrons because of the ambipolar electric field, or space charge field, which appears almost immediately within the plasma and counters any imbalance between the populations of positive ions and electrons, this electric field, which is not disrupted by any electric field applied, very effectively ensuring the electrical neutrality of the plasma ejected from said thruster.

By concentrating the magnetic field lines thereon, the pointed end 36 of the injection means 10 makes it possible, starting from the magnetic field generator 50, to achieve, on the one hand, the first local maximum of intensity A and, on the other hand, a microhollow cathode discharge, between the first local maximum A and the local minimum B of the intensity of the magnetic field. This microdischarge is sufficient to ionize at least a portion of the propellant gas present in said injection nozzle 65, whatever its flow rate. The magnetic field generator 50 comprises for example permanent magnets.

The invention claimed is:

1. A plasma thruster comprising: a discharge chamber comprising an internal cavity and an outlet opening; at least one injection means comprising an injection nozzle capable of injecting into the discharge chamber a propellant gas along a predefined axis, said injection nozzle having an outlet end; a magnetic field generator capable of setting electrons of the propellant gas present in the discharge chamber in gyromagnetic rotation; and an electromagnetic wave generator capable of irradiating the propellant gas present in the discharge chamber by generating at least one electromagnetic wave the electric field of which has a right-hand circular polarization and a frequency equal to the frequency, $f_{ECR}$, of gyromagnetic resonance of the electrons of the propellant gas magnetized by said magnetic field generator, wherein said magnetic field generator is capable:

on the one hand, of generating a magnetic field having:

a first local maximum of intensity inside the injection nozzle and at the outlet end of the injection nozzle;

field lines which determine an iso-field surface, known as the "ECR surface", with an intensity equal to that allowing a cyclotron resonance of the electrons under the effect of said electromagnetic wave, said ECR surface enveloping the outlet end of said injection nozzle, the volume delimited by this ECR surface being the resonant cavity of the electromagnetic wave;

a second local maximum of the intensity of the magnetic field inside the injection nozzle, separated from the first local maximum by a local minimum of the intensity of the magnetic field inside said injection nozzle;

on the other hand, of giving said field lines the shape of a nozzle, so as to generate a diamagnetic propulsion force;

said injection means:

is produced from an electrically conductive material and is electrically connected to the electromagnetic wave generator so as to also operate as an electromagnetic antenna emitting said electromagnetic wave into the propellant gas at the outlet of said injection nozzle;

is produced from a magnetically conductive material, making it possible to achieve, inside the latter, said second local maximum of the intensity of the magnetic field; and comprises, at the downstream end of said injection nozzle, an injection channel with an external diameter of less than a few millimeters.

2. The plasma thruster according to claim 1, in which the magnetic field generator comprises as magnetic field source at least one permanent magnet with a toric shape arranged coaxially to the predefined axis and having a first magnetic pole and a second magnetic pole, a first magnetic element integral with the first magnetic pole and a second magnetic element integral with the second magnetic pole, said first and second magnetic poles being arranged at a first distance and, respectively, a second distance from the predefined axis; the second distance being longer than the first distance, the first magnetic pole and the second magnetic pole being arranged upstream and, respectively, downstream of the injection nozzle with respect to the direction of flow of the propellant gas, the field lines intersecting with the injection nozzle and forming an angle comprised between 10° and 70° with said predefined axis.

3. The plasma thruster according to claim 1, in which the length, defined along the predefined axis, of the internal cavity of the discharge chamber is 5 to 10 times smaller than the half-wavelength of said electromagnetic wave in a vacuum, the discharge chamber having an internal cross-sectional area comprised between 0.7 square centimeters and 30 square centimeters; in which the central injection channel has an internal cross-sectional area comprised between 0.7 square millimeters and 3 square millimeters.

4. The plasma thruster according to claim 1, in which the magnetic field intensities of said first local maximum, local minimum and second local maximum are, respectively, 0.18 tesla, 0.01 tesla and 0.05 tesla.

5. The plasma thruster according to claim 1, in which said electromagnetic wave is capable of propagating along an axis parallel to the predefined axis and in which, at the predefined axis, the magnetic field gradient is parallel to the predefined axis; said magnetic field gradient being negative from upstream to downstream in a direction defined by the direction in which the propellant gas is ejected.

6. The plasma thruster according to claim 1, wherein the plasma thruster is configured to modulate a power of the electromagnetic wave and control a flow rate of the propellant gas, said power of the electromagnetic wave being between 0.5 watts and 300 watts, and between 0.5 watts and 30 watts in a first operating mode.

7. The plasma thruster according to claim 1, which further comprises, a circulator, arranged at an outlet of said electromagnetic wave generator and, an electrically conductive cylindrical sleeve, arranged downstream of a plane defined by the outlet opening known as an outlet plane of the plasma thruster, wherein a diameter of the electrically conductive cylindrical sleeve is equal to one quarter of the wavelength of the electromagnetic wave and the length of which is equal to three quarters of the wavelength of the electromagnetic wave.

8. The plasma thruster according to claim 1, further comprising two injection means coaxial to the axis, one supplying gas to be ionized to the ECR surface and the other increasing the thrust via a gas flow rate and an arcjet operation.

9. A method for generating a propulsion thrust by means of a plasma thruster comprising the following steps:

injection, into a discharge chamber comprising an internal cavity and an outlet opening, using at least one injection means comprising an injection nozzle, of a propellant gas along a predefined axis;

generation, using a magnetic field generator, of a magnetic field of setting electrons of the propellant gas present in the discharge chamber in gyromagnetic rotation;

emission into the propellant gas present in the discharge chamber, using an electromagnetic wave generator, of at least one electromagnetic wave an electric field of which has a right-hand circular polarization and a frequency equal to the gyromagnetic resonance frequency, $f_{ECR}$, of the electrons of the propellant gas magnetized by said magnetic field generator;

ignition of a plasma by ionization of the propellant gas; and sustaining of the plasma by cyclotron resonance of the electrons;

wherein:

the ignition of the plasma is realized by microhollow cathode discharge using the injection means which is made of magnetic material and comprises, at the downstream end of its injection nozzle, an injection channel with an external diameter of less than a few millimeters;

the injection of the propellant gas and the emission of the electromagnetic wave are carried out by the injection means and at a location in the discharge chamber, said injection means being produced from an electrically conductive material and electrically connected to the electromagnetic wave generator in order to emit the electromagnetic wave into the propellant gas at the outlet of the gas from said injection nozzle, so as to maximize the level of ionization of the propellant gas on exiting;

said magnetic field generation is such that:

the magnetic field has:

a first local maximum of the intensity of the magnetic field situated inside the injection nozzle and at the outlet end of the injection nozzle;

field lines which determine an iso-field surface, known as an ECR surface, with an intensity equal to that allowing a cyclotron resonance of the electrons under the effect of said electromagnetic wave, said ECR surface enveloping the outlet end of said injection nozzle;

a second local maximum of the intensity of the magnetic field inside the injection nozzle, separated from the first local maximum by a local minimum of the intensity of the magnetic field inside said injection nozzle;

the magnetic field gives said field lines the shape of a nozzle, so as to generate a diamagnetic force; and sustaining of the plasma by cyclotron resonance of the electrons being realized by resonance of the electromagnetic wave in the volume delimited by the ECR surface.

10. The method according to claim 9, in which the plasma thruster moreover comprises a device for modulating the power of the electromagnetic wave, a device for controlling the gas flow rate, a peripheral injection channel capable of injecting the propellant gas into the discharge chamber; and in which the method further comprises the following steps:

injection of propellant gas into the discharge chamber via the peripheral injection channel;

regulation of the flow rate of propellant gas injected into the discharge chamber via the peripheral injection channel; and modulation of the power of the electromagnetic wave.

* * * * *